US009986607B2

(12) United States Patent
Park et al.

(10) Patent No.: US 9,986,607 B2
(45) Date of Patent: May 29, 2018

(54) LIGHT EMITTING DIODE CONTROL CIRCUIT WITH HYSTERETIC CONTROL AND LOW-SIDE OUTPUT CURRENT SENSING

(71) Applicant: FAIRCHILD KOREA SEMICONDUCTOR LTD., Bucheon (KR)

(72) Inventors: Inki Park, Seoul (KR); Taesung Kim, Seoul (KR); Seunguk Yang, Anyang (KR)

(73) Assignee: SEMICONDUCTOR COMPONENTS INDUSTRIES, LLC, Phoenix, AZ (US)

( * ) Notice: Subject to any disclaimer, the term of this patent is extended or adjusted under 35 U.S.C. 154(b) by 0 days. days.

(21) Appl. No.: 15/610,706

(22) Filed: Jun. 1, 2017

(65) Prior Publication Data

US 2017/0354004 A1 Dec. 7, 2017

Related U.S. Application Data

(60) Provisional application No. 62/344,763, filed on Jun. 2, 2016.

(51) Int. Cl.
*H05B 37/02* (2006.01)
*H05B 33/08* (2006.01)

(52) U.S. Cl.
CPC ..... *H05B 33/0815* (2013.01); *H05B 33/089* (2013.01); *H05B 33/0842* (2013.01)

(58) Field of Classification Search
CPC .. H05B 41/28; H05B 41/295; H05B 41/2827; H05B 41/3925; H05B 33/0815; H05B 33/0818; H05B 41/2828; H05B 41/3921; H05B 41/3927; H05B 41/2855; H05B 41/386; H05B 41/2882; Y02B 20/202; Y02B 20/204
See application file for complete search history.

(56) References Cited

U.S. PATENT DOCUMENTS 9,826,608 B2 * 11/2017 Eum ..... H05B 39/044
2013/0221871 A1 * 8/2013 King ..... H05B 37/02 315/254

OTHER PUBLICATIONS

Infineon, "International IOR Rectifier, End of Life LEDrivIR," IRS2980S LED Driver Control IC Data Sheet, Oct. 15, 2015 [retrieved on May 22, 2017]. Retrieved from the Internet <URL: http://www.infineon.com/dgdl/irs2980spbf.pdf?fileId=5546d462533600a40153567b8108284e>.

* cited by examiner

*Primary Examiner* — Minh D A

(57) ABSTRACT

An LED control circuit controls a switching operation of a switch by hysteretic control. The LED control circuit includes a controller integrated circuit (IC) that senses a current sense voltage from a current sense resistor that is on a low-side of the switch. The LED control circuit senses the current sense voltage during on-time of the switch to determine when to turn off the switch. During off-time of the switch, the controller IC determines when to turn on the switch by comparing a sawtooth voltage to a turn-on threshold that is generated from the on-time of the switch.

20 Claims, 4 Drawing Sheets

LIGHT EMITTING DIODE CONTROL CIRCUIT WITH HYSTERETIC CONTROL AND LOW-SIDE OUTPUT CURRENT SENSING

CROSS-REFERENCE TO RELATED APPLICATION

This application claims the benefit of U.S. Provisional Application No. 62/344,763, filed on Jun. 2, 2016, which is incorporated herein by reference in its entirety.

BACKGROUND OF THE INVENTION

1. Field of the Invention

The present invention relates generally to electrical circuits, and more particularly but not exclusively to light emitting diode control circuits.

2. Description of the Background Art

A light emitting diode (LED) may be used in various lighting applications. For example, one or more LEDs may provide illumination by driving the LEDs using a transistor. An LED control circuit may receive an input voltage to generate a regulated output current that is provided to the LEDs. The LED control circuit may include a controller integrated circuit (IC) to control the switching operation of the transistor by pulse width modulation (PWM) or hysteretic control. When employed in a continuous conduction mode (CCM) buck topology, hysteretic control provides the benefits of no or minimum flicker and output current overshoot. However, in conventional CCM buck converters with hysteretic control, the output current is delivered during the on-time and the off-time of the transistor. Therefore, the output current needs to be continuously sensed during the switching cycle for regulation. This requires output current sensing, which leads to power loss on the sense resistor, during both the on-time and the off-time.

SUMMARY

In one embodiment, an LED control circuit controls a switching operation of a switch by hysteretic control. The LED control circuit includes a controller integrated circuit (IC) that senses a current sense voltage from a current sense resistor that is on a low-side of the switch. The LED control circuit senses the current sense voltage during on-time of the switch to determine when to turn off the switch. During off-time of the switch, the controller IC determines when to turn on the switch by comparing a sawtooth voltage to a turn-on threshold that is generated from the on-time of the switch.

These and other features of the present invention will be readily apparent to persons of ordinary skill in the art upon reading the entirety of this disclosure, which includes the accompanying drawings and claims.

Figure 1:
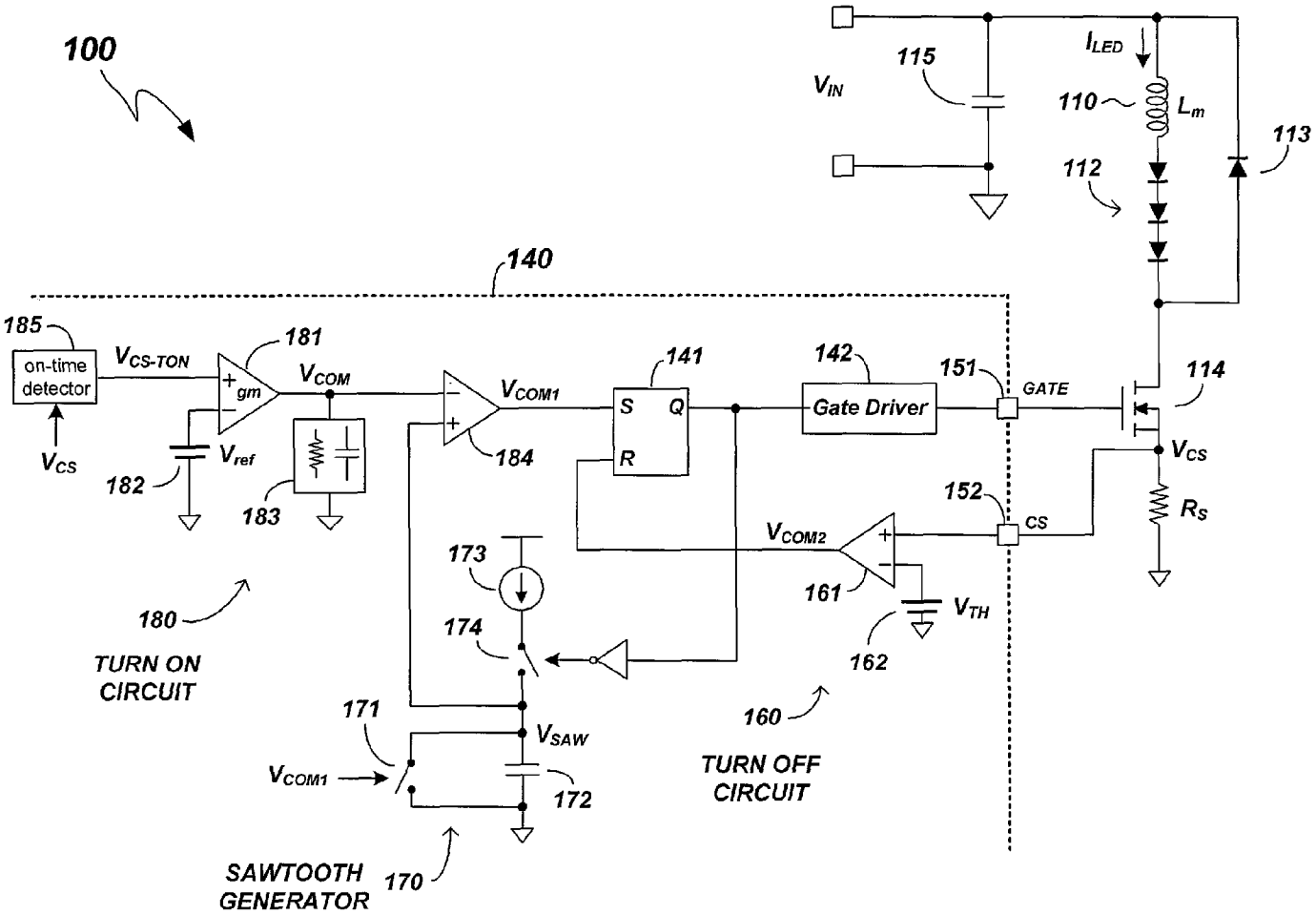
FIG. 1 shows a schematic diagram of an LED control circuit in accordance with an embodiment of the present invention.

The use of the same reference label in different drawings indicates the same or like components.

DETAILED DESCRIPTION

In the present disclosure, numerous specific details are provided, such as examples of circuits, components, and methods, to provide a thorough understanding of embodiments of the invention. Persons of ordinary skill in the art will recognize, however, that the invention can be practiced without one or more of the specific details. In other instances, well-known details are not shown or described to avoid obscuring aspects of the invention.

For ease of reading, subscripts and superscripts that appear in the drawings are formatted below as normal fonts . For example, a signal that is labeled in the drawings as $V_{EXAMPLE}$ is simply written below as VEXAMPLE.

FIG. 1 shows a schematic diagram of an LED control circuit 100 in accordance with an embodiment of the present invention. In the example of FIG. 1, the LED control circuit 100 has a continuous conduction mode (CCM) buck converter topology with hysteretic control. In the example of FIG. 1, the LED control circuit 100 comprises an inductor 110, a diode string 112,a switch in the form of a transistor 114, an LED circuit 113, a sense resistor RS, and a controller integrated circuit (IC) 140. The diode string 112 may comprise a single diode or a plurality of diodes that are connected in series. Similarly, the LED circuit 113 may comprise a single LED or a plurality of LEDs that are connected in series. The LED control circuit 100 receives an input voltage VIN, which is filtered by an input capacitor 115. In one embodiment, the input voltage VIN is a DC (i.e., direct current) voltage.

In the example of FIG. 1, the transistor 114 is a metal oxide semiconductor field effect transistor (MOSFET) with a drain that is connected to a cathode of the diode string 112, a gate that is connected to a gate pin 151 of the controller IC 140, and a source that is connected to an end of the sense resistor RS. The other end of the sense resistor RS is connected to ground. Because the sense resistor RS is disconnected from the input voltage VIN when the transistor 114 is off, the sense resistor RS is referred to as being on the low side of the transistor 114. Components on other side of the transistor 114 towards the input voltage VIN, e.g., diode string 112, is referred to as being on the high side of the transistor 114.

Briefly, when the transistor 114 is on, the input voltage VIN is connected to ground through the transistor 114. The resulting output current ILED flows through the inductor 110, the diode string 112, the transistor 114, and the sense resistor RS. Accordingly, a current sense voltage VCS that is developed by the output current ILED on the sense resistor RS is indicative of the of the output current ILED. When the transistor 114 is off, the input voltage VIN is disconnected from ground, and the output current ILED flows through the inductor 110, the diode string 112, and the LED circuit 113. The controller IC 140 controls the switching operation of the transistor 114 to regulate the output current ILED, and thus the illumination provided by the LED circuit 113.

In one embodiment, the controller IC 140 comprises a turn off circuit 160, a sawtooth generator 170, and a turn on circuit 180. Circuits of the controller IC 140 that are not necessary to the understanding of the invention, such as soft-start circuits, protection circuits, internal bias circuits, etc., are not shown for clarity of illustration.

In the example of FIG. 1, the controller IC 140 senses the output current ILED by low-side current sensing. More particularly, the controller IC 140 includes a current sense (CS) pin 152 for receiving the current sense voltage VCS, which is indicative of the output current ILED. The turn off circuit 160, which comprises a comparator 161, is configured to turn off the transistor 114 based on the current sense voltage VCS. The comparator 161 compares the current sense voltage VCS to a threshold voltage 162, which serves as a turn-off threshold. When the current sense voltage VCS is higher than the threshold voltage 162, the comparator 161 generates a comparator output voltage VCOM2 that resets an SR flip-flop 141, thereby generating a gate drive signal GATE that turns off the transistor 114. A gate driver 142 provides suitable drive current to drive the gate of the transistor 114.

The sawtooth generator 170 is configured to generate the sawtooth voltage VSAW, which serves as an increasing control signal for determining when to turn on the transistor 114. In the example of FIG. 1, the sawtooth generator 170 comprises a switch 171, a capacitor 172, a constant current source 173, and a switch 174. When the switch 174 is closed, the current source 173 charges the capacitor 172 to generate the sawtooth voltage VSAW. Opening the switch 174 stops the charging of the capacitor 172. In the example of FIG. 1, the state of the switch 174 is dictated by the gate drive signal GATE. More particularly, the switch 174 is closed when the Q output of the SR flip-flop 141 is at a logic low (i.e., when the transistor 114 is turned off), and the switch 174 is open when the Q output of the SR flip-flop 141 is at a logic high (i.e., when the transistor 114 is turned on). In the example of FIG. 1, closing the switch 171 shorts the capacitor 172 to reset the sawtooth voltage VSAW. In one embodiment, the state of the switch 171 is dictated by a comparator output voltage VCOM1 that is generated by a comparator 184. The generation of the comparator output voltage VCOM1 is further explained below.

In the example of FIG. 1, the turn on circuit 180 comprises an on-time detector 185, an operational transconductance amplifier (OTA) 181, and the comparator 184. In one embodiment, the OTA 181 provides error compensation. An RC circuit 183 at the output of the OTA 181 sets the phase and gain of the OTA 181. The values of the resistor and capacitor of the RC circuit 183 may be set for loop compensation. In the example of FIG. 1, the on-time detector 185 is configured to detect an on-time of the transistor 114 from the current sense voltage VCS to generate an on-time voltage VCS-TON that is indicative of the on-time of the transistor 114. The on-time detector 185 may be implemented by a timer circuit or other suitable circuit for measuring on-time. In the example of FIG. 1, the longer the on-time of the transistor 114, the higher the level of the of on-time voltage VCS-TON; the shorter the on-time of the transistor 114, the lower the level of the on-time voltage VCS-TON. The OTA 181 compares the on-time voltage VCS-TON to a reference voltage 182 to generate a comparator output voltage VCOM, which serves as a turn-on threshold voltage. The comparator 184 compares the comparator output voltage VCOM to the sawtooth voltage VSAW to generate the comparator output voltage VCOM1. When the sawtooth voltage VSAW increases to the level of the comparator output voltage VCOM, the comparator output voltage VCOM1 is asserted to set the SR flip-flop 141 and thereby turn on the transistor 114. Asserting the comparator output voltage VCOM1 also closes the switch 171 to reset the sawtooth voltage VSAW.

In the example of FIG. 1, the transistor 114 is turned off based on the threshold voltage 162 and the current sense voltage VCS. The transistor 114 is turned on based on the level of the sawtooth voltage VSAW relative to the comparator output voltage VCOM, which is generated from the on-time voltage VCS-TON. The off-time of the transistor 114 is controlled by sensing the on-time of the transistor 114 to generate the on-time voltage VCS-TON and setting the value of the comparator output voltage VCOM based on the value of the on-time voltage VCS-TON. In the example of FIG. 1, when the on-time voltage VCS-TON is greater than the reference voltage 182, the comparator output voltage VCOM increases, thereby increasing the off-time of the transistor 114. When the on-time voltage VCS-TON is less than the reference voltage 182, the comparator output voltage VCOM decreases, thereby decreasing the off-time of the transistor 114.

The controller IC 140 controls the transistor 114 in accordance with hysteretic control because both the turn on and the turn off of the transistor 114 are actively controlled based on the output current ILED. Energy efficiency is improved because the current sense voltage VCS is sensed only during the on-time of the transistor 114 to determine when to turn the transistor 114 off. The current sense voltage VCS is not sensed during the off-time of the transistor 114. Instead, during the off-time of the transistor 114, the instance of when to turn on the transistor 114 is determined based on the internally generated sawtooth voltage VSAW and the on-time voltage VCS-TON.

Figure 2:
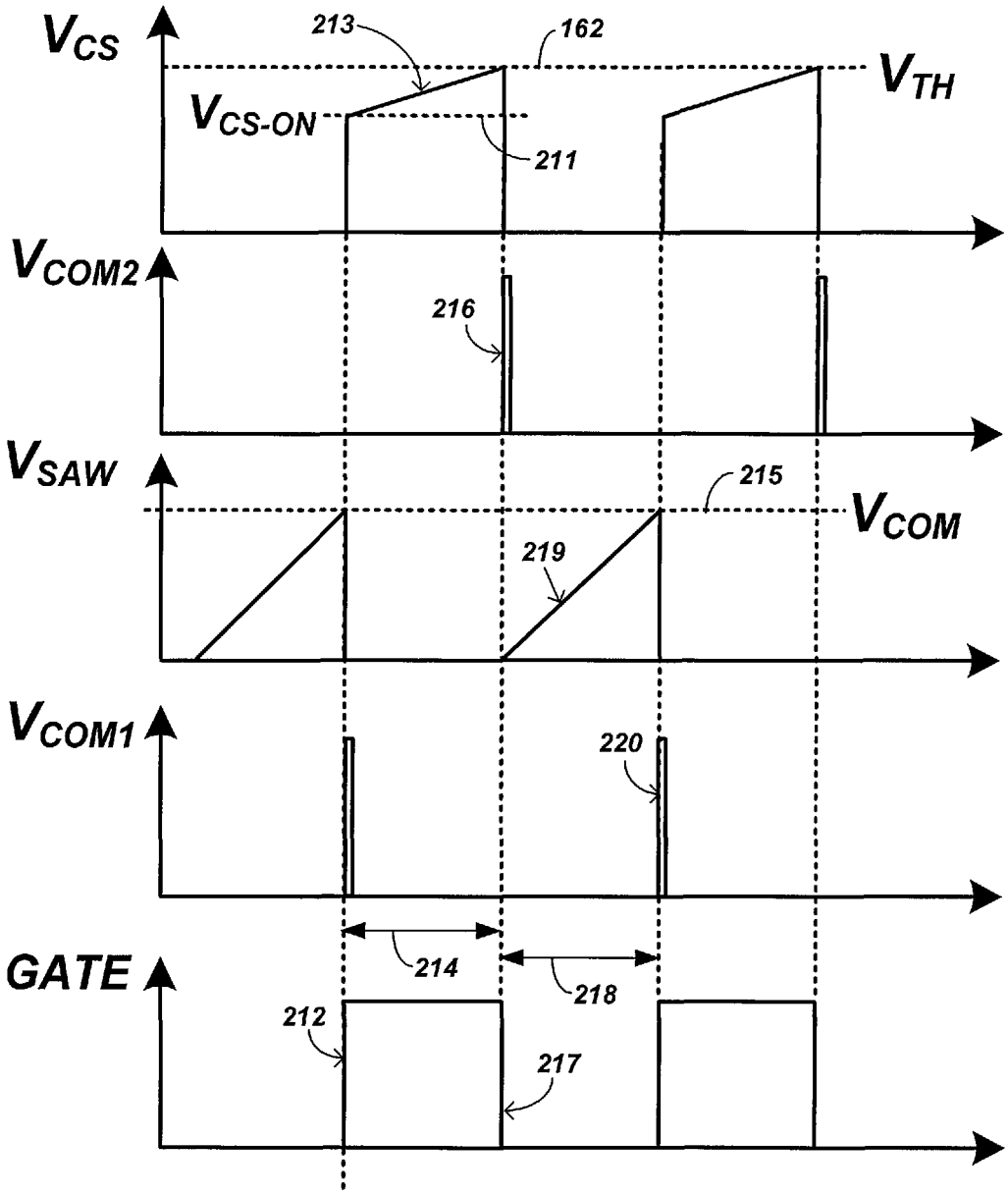
FIG. 2 shows waveforms of signals of the LED control circuit of FIG. 1 in accordance with an embodiment of the present invention.

FIG. 2 shows waveforms of signals of the LED control circuit 100 in accordance with an embodiment of the present invention. FIG. 2 shows, from top to bottom, the current sense voltage VCS, the comparator output voltage VCOM2, the sawtooth voltage VSAW, the comparator output voltage VCOM1, and the gate drive signal GATE. FIG. 2 also shows the levels of the threshold voltage 162, an onset voltage VCS-ON (FIG. 2, 211), and the comparator output voltage VCOM (FIG. 2, 215).

In the example of FIG. 2, the onset voltage VCS-ON (FIG. 2, 211) is the level of the current sense voltage VCS at the beginning of the on-time (FIG. 2, 212) of the transistor 114. The comparator output voltage VCOM (FIG. 2, 215) is generated at the beginning of the on-time of the transistor 114 (FIG. 2, 212) when the current sense voltage VCS reaches the onset voltage VCS-ON (FIG. 2, 210). More particularly, the on-time detector 185 measures the on-time of the transistor 114, reads the value of the current sense voltage VCS, and generates the on-time VCS-TON when the sense voltage VCS reaches the onset voltage VCS-ON.

The sawtooth voltage VSAW increases (FIG. 2, 213) from the onset voltage VCS-ON to the threshold voltage 162 during the on-time of the transistor 114 (FIG. 2, 214). The on-time of the transistor 114 ends when the current sense voltage VCS reaches the threshold voltage 162. The on-time detector 185 senses the time it took for the current sense voltage VCS to increase from the onset voltage VCS-ON to the threshold voltage 162 to generate the on-time voltage VCS-TON, which is used to generate the comparator output voltage VCOM (FIG. 2, 215).

When the current sense voltage VCS reaches the threshold voltage 162, the comparator output voltage VCOM2 is asserted (FIG. 2, 216), which turns off the transistor 114 (FIG. 2, 217) and initiates its off-time (FIG. 2, 218). The sawtooth voltage VSAW increases during the off-time of the transistor 114 (FIG. 2, 219). When the sawtooth voltage VSAW reaches the comparator output voltage VCOM, the comparator output voltage VCOM1 is asserted (FIG. 2, 220) to turn on the transistor 114 and begin the next switching cycle.

Figure 3:
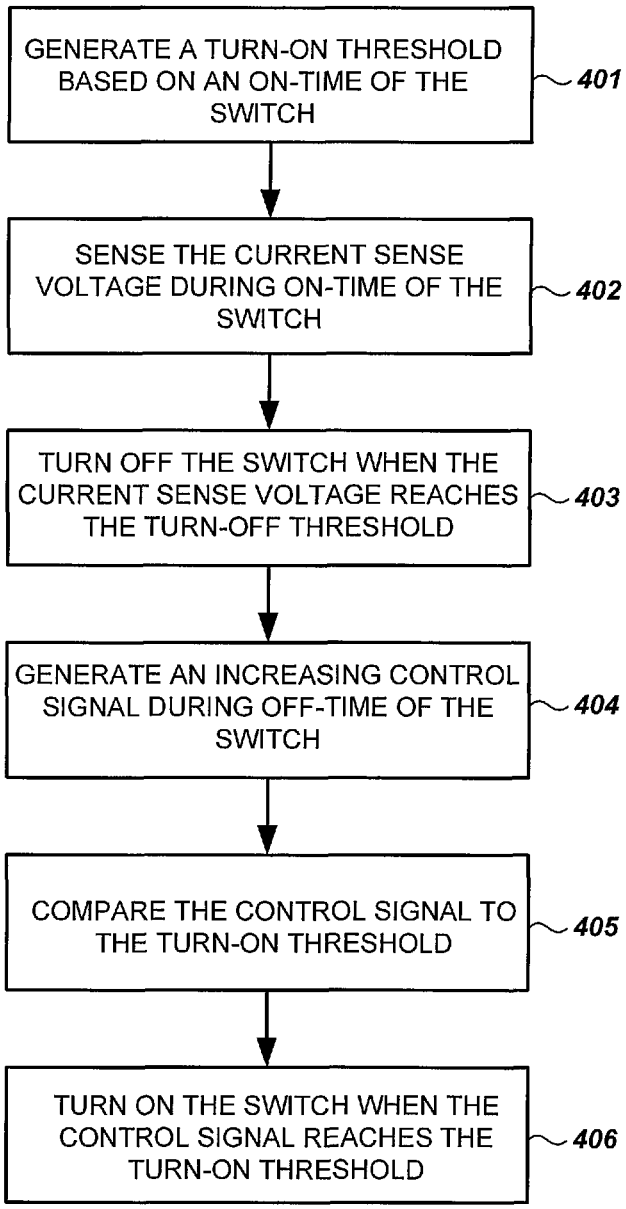
FIG. 3 shows a flow diagram of a method of operating an LED control circuit in accordance with an embodiment of the present invention.

FIG. 3 shows a flow diagram of a method of operating an LED control circuit in accordance with an embodiment of the present invention. The method of FIG. 3 may be performed by the LED control circuit 100 of FIG. 1.

In the example of FIG. 3, a turn-on threshold (e.g., comparator output voltage VCOM) is generated based on a detected on-time of the switch (e.g., on-time voltage VCS-TON) (step 401). A current sense voltage (e.g., current sense voltage VCS) is sense during the on-time of the switch (step 402). The switch is turned off when the current sense voltage reaches a turn-off threshold (e.g., threshold voltage 162) (step 403). An increasing control signal (e.g., sawtooth voltage VSAW) is generated during the off-time of the switch (step 404). The control signal is compared to the turn-on threshold to determine when to turn on the switch (step 405). The switch is turned on when the control signal reaches the turn-on threshold (step 406).

Figure 4:
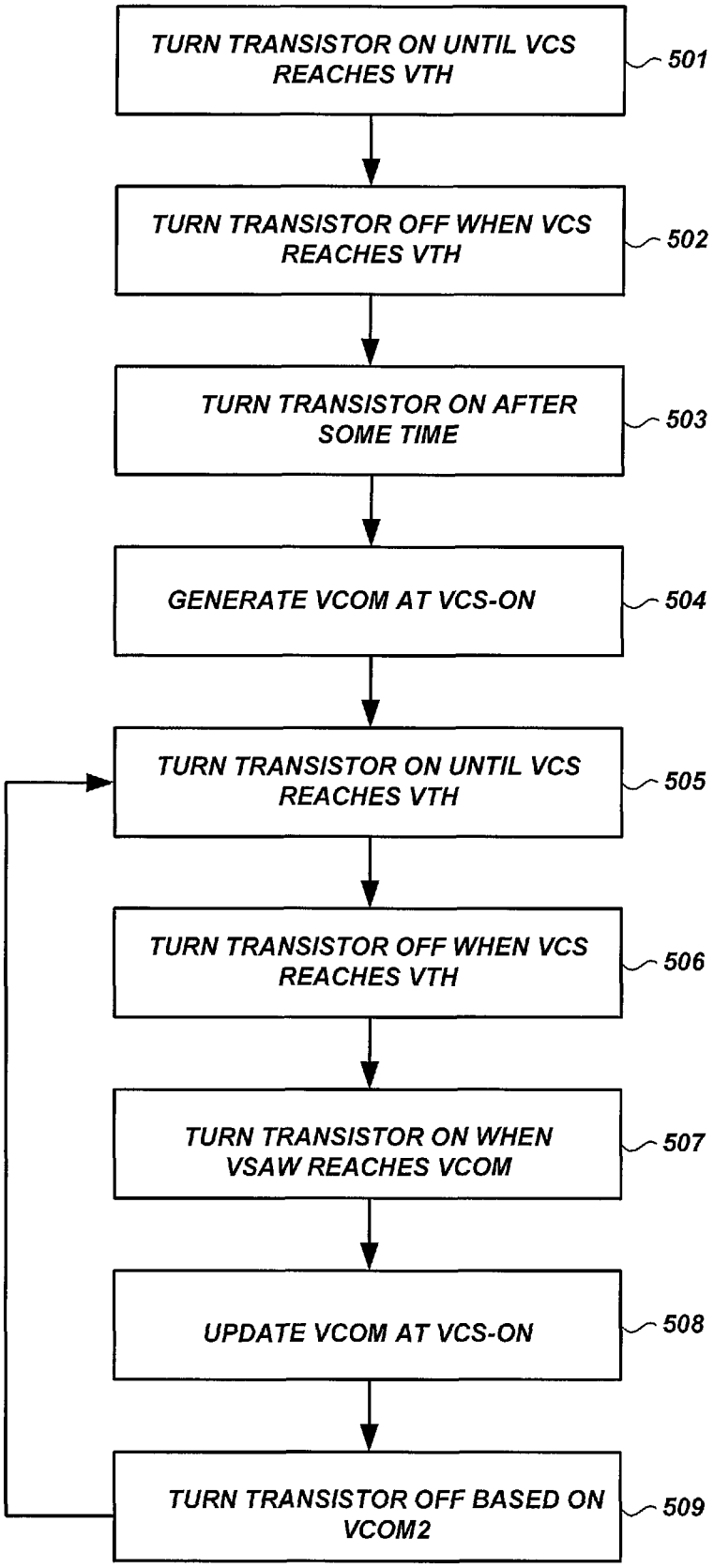
FIG. 4 shows a flow diagram of a method of operating the LED control circuit of FIG. 1 in accordance with an embodiment of the present invention.

FIG. 4 shows a flow diagram of a method of operating the LED control circuit 100 of FIG. 1 in accordance with an embodiment of the present invention. In the example of FIG. 4, the steps 501-504 may be performed at startup of the LED control circuit 100, and the steps 505-509 may be performed at steady-state during normal operation.

At startup, the transistor 114 is turned on until the current sense voltage VCS reaches the threshold voltage 162 (step 501). The transistor 114 is turned off when the current sense voltage VCS reaches the threshold voltage 162 (step 502), and then turned back on after some (e.g., random, temporary, predetermined) time (step 503). The comparator output voltage VCOM is generated at the beginning of the on-time of the transistor 114 (step 504), which occurs when the on-time detector 185 detects that the current sense voltage VCS reaches the onset voltage VCS-ON. In the example of FIG. 1, the onset voltage VCS-ON is a reference voltage that is internal to the on-time detector 185.

Continuing the example of FIG. 4, the transistor 114 is kept on until the current sense voltage VCS reaches the threshold voltage 162 (step 505). The transistor 114 is turned off when the current sense voltage VCS reaches the threshold voltage 162 (step 506). The transistor 114 is turned on when the sawtooth voltage VSAW reaches the comparator output voltage VCOM (step 507). The comparator output voltage VCOM is updated at the beginning of the on-time of the transistor 114 (step 508). The transistor 114 is turned off based on the comparator output voltage VCOM2 of the comparator 161 (step 509). More specifically, the transistor 114 is turned off the when the current sense voltage VCS reaches the threshold voltage 162. The cycle comprising the steps 505-509 is thereafter repeated during normal operation.

LED control circuits with low-side current sensing and hysteretic control have been disclosed. While specific embodiments of the present invention have been provided, it is to be understood that these embodiments are for illustration purposes and not limiting. Many additional embodiments will be apparent to persons of ordinary skill in the art reading this disclosure.

What is claimed is:

1. A light emitting diode (LED) control circuit comprising:

a metal oxide semiconductor (MOS) transistor, the MOS transistor having a first terminal that is connected to an input voltage of the LED control circuit;

a sense resistor having a first end connected to a second terminal of the MOS transistor and a second end that is connected to ground;

a controller integrated circuit (IC) that is configured to control a switching operation of the MOS transistor by hysteretic control, to sense a current sense voltage that is developed on the sense resistor by an output current, to turn off the MOS transistor when the current sense voltage reaches a first threshold voltage, to generate a sawtooth voltage, and to turn on the MOS transistor when the sawtooth voltage reaches a second threshold voltage.

2. The LED control circuit of claim 1, wherein the controller IC comprises:

a first pin that receives the current sense voltage;

a first comparator that is configured to compare the current sense voltage to the first threshold voltage to generate a first comparator output voltage for turning off the MOS transistor.

3. The LED control circuit of claim 1, wherein the controller IC comprises a sawtooth generator that is configured to generate the sawtooth voltage, the sawtooth generator comprising:

a current source; and a capacitor that is charged by the current source to generate the sawtooth voltage during an off-time of the MOS transistor.

4. The LED control circuit of claim 3, wherein the sawtooth generator further comprises:

a switch that is configured to connect the current source to the capacitor when the MOS transistor is turned off.

5. The LED control circuit of claim 3, wherein the sawtooth voltage is reset when the MOS transistor is turned on.

6. The LED control circuit of claim 1, wherein the controller IC comprises:

a transconductance amplifier that is configured to generate the second threshold voltage by comparing a reference voltage to an on-time voltage that is indicative of an on-time of the MOS transistor.

7. The LED control circuit of claim 6, wherein the controller IC further comprises:

a second comparator that is configured to compare the sawtooth voltage to the second threshold voltage to generate a second comparator output voltage for turning on the MOS transistor.

8. The LED control circuit of claim 1, wherein the controller IC further comprises:

a second pin that is connected to a gate terminal of the MOS transistor; and a gate driver for driving the gate terminal of the MOS transistor through the second pin.

9. A controller integrated circuit (IC) for controlling a switching operation of a switch of a light-emitting diode (LED) control circuit, the controller IC comprising:

a turn off circuit that is configured to receive a current sense voltage from a sense resistor that is connected between a terminal of the switch and ground, and to turn off the switch when the current sense voltage reaches a first threshold voltage, the current sense voltage being indicative of an output current of the LED control circuit; and a turn on circuit that is configured to generate a second threshold voltage based on an on-time of the switch, and to turn on the switch when a control voltage that is increasing during an off-time of the switch reaches the second threshold voltage.

10. The controller IC of claim 9, wherein the turn off circuit comprises:

a first comparator that is configured to compare the current sense voltage to the first threshold voltage to generate a first comparator output voltage for turning off the switch.

11. The controller IC of claim 9, wherein the control voltage is a sawtooth voltage that is generated by a sawtooth generator.

12. The controller IC of claim 11, wherein the sawtooth generator comprises:

a current source; and a capacitor that is charged by the current source during the off-time of the switch.

13. The controller IC of claim 11, wherein the turn on circuit comprises:

an operational transconductance amplifier (OTA) that is configured to generate the second threshold voltage by comparing a reference voltage to an on-time voltage that is indicative of the on-time of the switch.

14. The controller IC of claim 13, wherein the turn on circuit further comprises:

a second comparator that is configured to compare the sawtooth voltage to the second threshold voltage to generate a second comparator output voltage for turning on the switch.

15. The controller IC of claim 9, wherein the switch comprises a metal oxide semiconductor field effect transistor (MOSFET).

16. A method of operating an LED control circuit comprising:

generating a turn-on threshold that is indicative of an on-time of a switch;

sensing a current sense voltage during the on-time of the switch, the current sense voltage being developed by an output current on a sense resistor during the on-time of the switch, the current sense voltage being indicative of the output current;

turning off the switch when the current sense voltage reaches a turn-off threshold to start an off-time of the switch;

increasing a control signal during the off-time of the switch; and turning on the switch when the control signal reaches the turn-on threshold.

17. The method of claim 16, wherein the control signal comprises a sawtooth voltage.

18. The method of claim 17, wherein increasing the control signal during the off-time of the switch comprises:

charging a capacitor during the off-time of the switch to generate the sawtooth voltage.

19. The method of claim 16, wherein the switch is a metal oxide semiconductor (MOS) transistor.

20. The method of claim 19, wherein sensing the current sense voltage during the off-time of the switch comprises:

sensing the current sense voltage from the sense resistor that is connected between a terminal of the MOS transistor and ground.

* * * * *